US007501988B2

(12) United States Patent
Schön et al.

(10) Patent No.: US 7,501,988 B2
(45) Date of Patent: Mar. 10, 2009

(54) ANTENNA DEVICE FOR A MOTOR VEHICLE AND THE RESPECTIVE MOTOR VEHICLE

(75) Inventors: Ingo Schön, Braunschweig (DE); Jörg Giere, Braunschweig (DE); Andreas Kelm, Wesendorf (DE); Bernhard Schittek, Cremlingen (DE); Joachim Schütz, Hillerse (DE); Andreas Kwoczek, Lehre (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 0 days.

(21) Appl. No.: 11/169,349

(22) Filed: Jun. 29, 2005

(65) Prior Publication Data

US 2006/0017631 A1 Jan. 26, 2006

(30) Foreign Application Priority Data

Jul. 2, 2004 (DE) ..... 10 2004 032 192

(51) Int. Cl.
*H01Q 1/32* (2006.01)

(52) U.S. Cl. ..... 343/713; 343/704; 343/711

(58) Field of Classification Search ..... 343/704, 343/711, 712, 713
See application file for complete search history.

(56) References Cited

U.S. PATENT DOCUMENTS

| | | | | |
|---|---|---|---|---|
| 4,760,042 | A | 7/1988 | Armstrong | 502/243 |
| 5,177,493 | A * | 1/1993 | Kawamura | 343/713 |
| 5,629,712 | A * | 5/1997 | Adrian et al. | 343/713 |
| 6,222,497 | B1 * | 4/2001 | Hu et al. | 343/846 |
| 6,433,749 | B1 | 8/2002 | Thompson | 343/713 |
| 6,603,434 | B2 | 8/2003 | Lindenmeier et al. | 343/713 |
| 6,624,794 | B1 * | 9/2003 | Wendt et al. | 343/864 |
| 6,900,769 | B2 * | 5/2005 | Schlieber et al. | 343/713 |
| 6,933,891 | B2 * | 8/2005 | Lange | 343/700 MS |
| 7,132,640 | B2 * | 11/2006 | Diaz et al. | 250/216 |
| 2002/0175868 | A1 | 11/2002 | Reichert | 343/713 |
| 2003/0112190 | A1 * | 6/2003 | Baliarda et al. | 343/713 |

FOREIGN PATENT DOCUMENTS

| | | | |
|---|---|---|---|
| DE | 100 25 931 | A1 | 8/2001 |
| DE | 101 00 812 | A1 | 7/2002 |
| DE | 101 13 285 | A1 | 10/2002 |
| EP | 0500380 | | 2/1992 |
| EP | 0862239 | | 9/1998 |
| EP | 1011167 | | 6/2000 |
| EP | 1 087 464 | A2 | 3/2001 |
| JP | 56142423 | | 11/1981 |
| JP | 2172304 | | 7/1990 |
| JP | 5063425 | | 3/1993 |
| JP | 2002518922 | | 6/2002 |
| WO | 9966595 | | 6/1999 |
| WO | 03007428 | | 1/2003 |
| WO | 2004030143 | A1 | 4/2004 |

* cited by examiner

*Primary Examiner*—Tho G Phan
(74) *Attorney, Agent, or Firm*—Baker Botts L.L.P.

(57) ABSTRACT

An antenna device (8) for a motor vehicle (10) is disclosed whereby the antenna device (8) includes a dielectric carrier (1) and components mounted on it, including at least one antenna (3; 6) and at least one impedance transformer (5) assigned to this one, as a minimum, antenna (6). In addition, the motor vehicle (10) is described with the antenna device (8) being mounted in a roof area (14) of the motor vehicle (10) and a spoiler (11) in which the antenna device (8) is mounted.

17 Claims, 1 Drawing Sheet

ANTENNA DEVICE FOR A MOTOR VEHICLE AND THE RESPECTIVE MOTOR VEHICLE

CROSS-REFERENCE TO RELATED APPLICATION

This application claims priority from German Patent Application No. 10 2004 032 192.2, which was filed on Jul. 2, 2004, and is incorporated herein by reference in its entirety.

TECHNICAL FIELD

The present invention involves an antenna device for a motor vehicle as well as a motor vehicle and a spoiler for a motor vehicle in which the antenna device is mounted.

BACKGROUND

Recently the number of the antennas installed in a motor vehicle has increased substantially. Aside from the obligatory radio antenna, today also TV antennas, mobile radio antennas and antennas for navigation are installed in a motor vehicle. According to the prior art these different antennas are adapted individually to the respective vehicle type and installed in different areas of the motor vehicle, as a result of which the respective antenna is designed differently for different vehicle types, leading to a large number of different antenna variants, which is a great disadvantage. In the process shortcomings in performance are tolerated that are due to a less than optimal installed location. It is also expensive to wire the antennas mounted in various areas of the vehicle. It also happens that the body of a vehicle must be specifically adapted for an antenna because of strong body feedback, entailing increased costs.

SUMMARY

The object of the present invention is therefore to offer an antenna device that avoids the disadvantages and problems described above.

That object can be achieved by an antenna device for a motor vehicle, wherein the antenna device includes a dielectric carrier and components mounted on it comprising at least one antenna.

The components mounted on the antenna device may include also at least one impedance transformer, wherein at least one of the impedance transformers is assigned to at least one of the antennas. At least one of the antennas can be printed or glued to the dielectric carrier. The antenna device may also includes a connection to a grounding of the motor vehicle. The at least one antenna may include at least one receiving antenna and/or at least one transmitting antenna. The at least one transmitting antenna may include a mobile radio antenna and/or a transmitting antenna for motor vehicle comfort control. The at least one receiving antenna may include a radio antenna, a mobile radio antenna, a television antenna, a DAB antenna, an SDARS antenna, a GPS antenna and/or a receiving antenna for motor vehicle comfort control. The components can be located on the same side of the dielectric carrier. The dielectric carrier can be made at least partially of a transparent material and/or at least partially of an opaque material. The antenna device may include at least one casing for at least one component. The antenna device may include a casing containing individual or all components. The dielectric carrier can be designed to bend and/or fold.

The object may also be achieved by a motor vehicle with a front window, a rear window and a roof extending along the motor vehicle from the front window to the rear window, wherein an antenna device includes a dielectric carrier and components mounted on it comprising at least one antenna, the antenna device being mounted in an area selected from the area group consisting of: the roof, an upper portion of the front window and an upper portion of the rear window.

The side of the dielectric carrier on which the components are not mounted, can be aimed upwards.

The object may further be achieved by a spoiler for a motor vehicle, wherein the spoiler contains the antenna device including a dielectric carrier and components mounted on it comprising at least one antenna.

The spoiler can be made of a dielectric material. The spoiler can be made partially of metal, whereby either the antenna device forms part of an outside area of the spoiler or whereby an area of the outside of the spoiler is made of a dielectric material, with the antenna device being mounted in that area.

An antenna device for a motor vehicle is offered within the framework of the present invention in which the antenna device includes a dielectric carrier and components mounted at this dielectric carrier. In turn, these components include at least one antenna. Additionally, the antenna device may include an impedance transformer assigned to this, as a minimum, one antenna, with the impedance transformer converting an emitter impedance passively or actively for example to a signal interface following it. The antenna device may also be connected to the grounding of the motor vehicle. In this case the, as a minimum, one antenna includes in particular at least one receiving antenna and/or at least one transmitting antenna.

By concentrating, according to the invention, different antennas of the motor vehicle in the antenna device, the installation of these antennas is made much easier, not least by bundling the on-board network connections, compared to installing these antennas individually and separately in the motor vehicle, making for example the production of the motor vehicle more cost-effective. Also, by bundling the different antennas in one location, i.e. in the antenna device, the number of motor vehicle variants can be reduced. By using a dielectric material for the carrier, the carrier does not have a negative impact on the transmittal and reception properties of the antennas. Another advantage concerns servicing: in case of an antenna failure one can only replace the complete antenna device or only the affected part of the antenna device, while in the second case there is the advantage of knowing exactly that the affected part can only be in the antenna device.

According to the invention the one, as a minimum, transmitting antenna may include a mobile radio antenna and/or a transmitting antenna for vehicle comfort control, while the one, as a minimum, receiving antenna may include a radio antenna, a mobile radio antenna, a television antenna, a DAB antenna (Digital Audio Broadcast; antenna for receiving digital radio), an SDARS antenna (Satellite Digital Audio Reception System; antenna for receiving digital radio transmitted via satellite), a GPS antenna and/or a receiving antenna for motor vehicle comfort control. Also, one or more antennas may be printed or glued onto the dielectric carrier.

In particular it is within the scope of the present invention to bundle with and integrate into the antenna device all antennas required for the motor vehicle with all extra components necessary for operating or mounting the antennas such as impedance transformers, housings and support elements.

The dielectric carrier is preferably made entirely or partially of a transparent material or opaque material, meaning that the dielectric carrier may also be made partially of a transparent and partially of an opaque material.

In case the dielectric carrier is partially made at least of a transparent material, it is possible to install the antenna device, at least partially, in a window area of the motor vehicle. If the antenna device is mounted in the roof area of the motor vehicle, at least a part of the roof area may be designed to be transparent. On the other hand it may be of advantage to make the dielectric carrier opaque in those areas where a component is installed in order to prevent the component from being seen.

According to the invention the antenna device may have a casing that encloses individual or all components. Alternatively the antenna device may have one or more casings, with each individual casing enclosing one or more of the components.

With the casing the antenna device may also be installed without additional equipment in areas of the motor vehicle that a passenger of the motor vehicle would normally look at often, for example in the area of the roof of the motor vehicle, or areas that passengers touch.

Within the framework of the present invention a motor vehicle with a front window, a rear window and a roof is also offered, with the roof extending along the motor vehicle from the front window to the rear window. In this case the antenna device described above is mounted in the roof area that extends from the upper portion of the front window over the roof to the upper portion of the rear window, i.e. the roof area comprises part of the front window as well as a part of the rear window.

The roof-area or upper part of the motor vehicle offers on the one hand advantages with regard to the receiving and transmitting properties of the antennas, and on the other hand the roof area has sufficient space to easily accommodate the antenna device. This makes it possible to use the same type of antenna device for more than one vehicle type, which is a big advantage for servicing (keyword: warehousing).

The present invention also offers a spoiler for a motor vehicle, with the spoiler containing the antenna device described above. In this case the spoiler can be made either of a dielectric material or at least partially of metal. In the second case the antenna device either forms part of the outside of the spoiler or an area on the outside of the spoiler is made of a dielectric material, with the antenna device being mounted in this area of the outside of the spoiler.

Like the roof area of the motor vehicle, the spoiler offers advantages in terms of the receiving and transmitting properties of the antennas because of its exposed location, and offers sufficient space to accommodate the antenna device. Also in this case it is possible to use the same type of antenna device for more than one vehicle type.

As described above, the antenna device according to the invention is particularly suited for mounting in a roof area or a spoiler of the motor vehicle. However, it is not restricted to these preferred mounting locations and may also be mounted in other areas of the motor vehicle such as for example the lid of the trunk.

BRIEF DESCRIPTION OF THE DRAWINGS

The present invention will be explained in more detail below by making reference to the enclosed illustration using a preferred example of embodiment.

DETAILED DESCRIPTION

Figure 1:
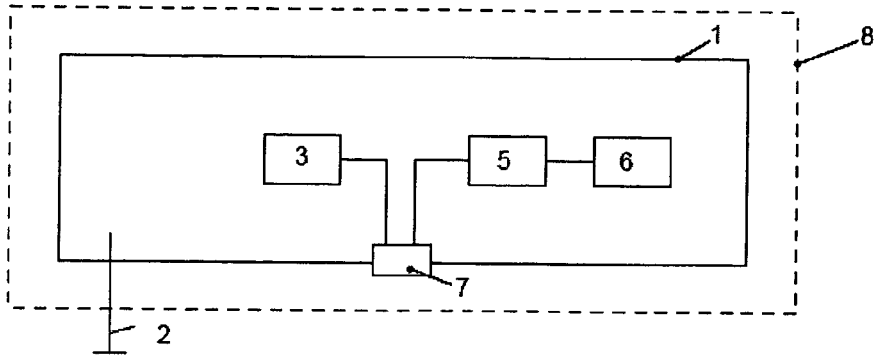
FIG. 1 shows a diagram of an antenna device according to the invention.

FIG. 1 shows a diagram of an antenna device 8 with a dielectric carrier 1 and components mounted on it. These components include a transmitting antenna 3 and a receiving antenna 6 as well as an impedance transformer 5 tuned to the receiving antenna 6. The impedance transformer 5 is connected electrically to an interface 7 of the antenna device 8 through which, on the one hand, the signals are fed into the transmitting antenna 3 and, on the other hand, the signals of the receiving antenna 6 can be scanned. The transmitting antenna 3 does not have an assigned impedance transformer because in the present example of embodiment it is assumed that the connected appliance transmitting via a transmitting antenna 3, for example a cell phone, has a sufficiently high transmission power. Additionally, the antenna device 8 is connected to the grounding 2 of the motor vehicle.

Figure 2:
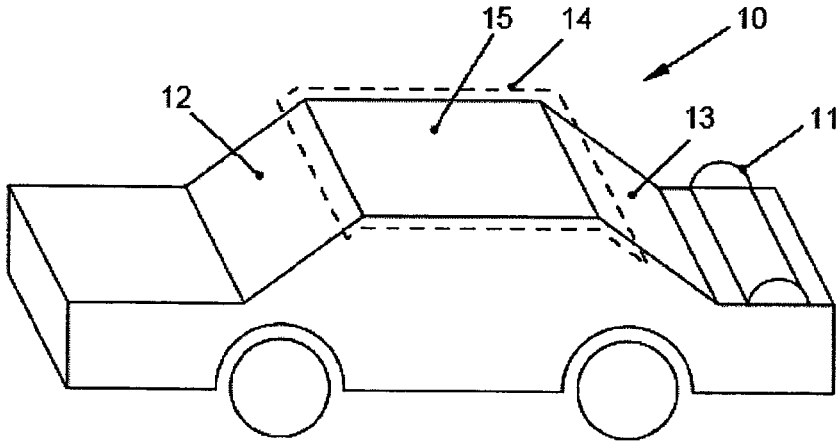
FIG. 2 shows a motor vehicle according to the invention with a spoiler according to the invention.

FIG. 2 shows a motor vehicle 10 with a spoiler 11. In this motor vehicle 10 the antenna device 8 described in FIG. 1 is either mounted in a roof area 14 or in the spoiler 11. In this case the roof area 14 includes the upper portion of the front window 12 of the motor vehicle 10 and the upper portion of the rear window 13 of the motor vehicle as well as the entire roof 15 of the motor vehicle 10. If the area where the antenna device 8 is mounted includes both a part of the front window 12 and a part of the roof 15, the antenna device 8 and the dielectric carrier 1 may be designed to bend or fold, which of course is part of the scope of the present invention.

We claim:

1. An antenna device for a motor vehicle, wherein the antenna device includes a dielectric carrier comprising at least one antenna and at least one component mounted on the dielectric carrier, wherein the dielectric carrier is made of an optically transparent material and is optically opaque in those areas where the at least one component is mounted.

2. An antenna device according to claim 1, wherein the at least one component mounted on the antenna device include also at least one impedance transformer, wherein at least one of the impedance transformers is assigned to at least one of the antennas.

3. An antenna device according to claim 1, wherein at least one of the antennas is printed or glued to the dielectric carrier.

4. An antenna device according to claim 1, wherein the antenna device also includes a connection to a grounding of the motor vehicle.

5. An antenna device according to claim 1, wherein the at least one antenna includes at least one receiving antenna and/or at least one transmitting antenna.

6. An antenna device according to claim 5, wherein the at least one transmitting antenna includes a mobile radio antenna and/or a transmitting antenna for motor vehicle comfort control.

7. An antenna device according to claim 5, wherein the at least one receiving antenna includes an antenna selected from the antenna group consisting of: a radio antenna, a mobile radio antenna, a television antenna, a DAB antenna, an SDARS antenna, a GPS antenna and a receiving antenna for motor vehicle comfort control.

8. An antenna device according to claim 1, wherein the at least one component is located on the same side of the dielectric carrier.

9. An antenna device according to claim 1, wherein the antenna device includes at least one casing for the at least one component.

10. An antenna device according to claim 1, wherein the antenna device includes a casing containing individual or all components.

11. An antenna device according to claim 1, wherein the dielectric carrier is designed to bend and/or fold.

12. An antenna device according to claim 1, wherein the antenna is contained within a spoiler of a motor vehicle.

13. A spoiler according to claim 12, wherein the spoiler is made of a dielectric material.

14. A spoiler according to claim 12, wherein the spoiler is made partially of metal, whereby either the antenna device forms part of an outside area of the spoiler or whereby an area of the outside of the spoiler is made of a dielectric material, with the antenna device being mounted in that area.

15. A motor vehicle comprising a front window, a rear window, a roof extending along the motor vehicle from the front window to the rear window, and an antenna device, wherein the antenna device includes a dielectric carrier comprising at least one antenna and at least one component mounted on the dielectric carrier, the antenna device being mounted in an area selected from the area group consisting of: the roof, an upper portion of the front window and an upper portion of the rear window, wherein the dielectric carrier is made of an optically transparent material and is optically opaque in those areas where the at least one component is mounted.

16. A motor vehicle according to claim 15, wherein the side of the dielectric carrier on which the at least one component is not mounted, is aimed upwards.

17. A motor vehicle with a front window, a rear window and a roof extending along the motor vehicle from the front window to the rear window, wherein an antenna device includes a dielectric carrier comprising at least one antenna and at least one component mounted on the dielectric carrier, the antenna device being mounted in an area selected from the area group consisting of: the roof, an upper portion of the front window and an upper portion of the rear window, wherein the dielectric carrier is made of an optically opaque material at least in that area where the at least one component is mounted.

* * * * *